US006502964B1

(12) United States Patent
Simon

(10) Patent No.: US 6,502,964 B1
(45) Date of Patent: Jan. 7, 2003

(54) DEVICES AND METHODS FOR DISTRIBUTING RADIALLY COLLECTED AND COLLIMATED LIGHT

(76) Inventor: Jerome H. Simon, 70 Sumner St., Newton Centre, MA (US) 02159

( * ) Notice: Subject to any disclaimer, the term of this patent is extended or adjusted under 35 U.S.C. 154(b) by 0 days.

(21) Appl. No.: 09/556,203

(22) Filed: Apr. 24, 2000

Related U.S. Application Data

(60) Provisional application No. 60/130,904, filed on Apr. 23, 1999.

(51) Int. Cl.[7] ..... F21V 7/09

(52) U.S. Cl. ..... 362/328; 362/291; 362/309; 362/310

(58) Field of Search ..... 362/145, 147, 362/290, 291, 296–299, 302, 308–310, 311, 326–329, 337, 340, 341, 346, 347, 285

(56) References Cited

U.S. PATENT DOCUMENTS 2,454,332 A * 11/1948 Mitchell et al. ..... 362/337
4,595,971 A * 6/1986 Dean ..... 362/345
5,416,684 A * 5/1995 Pearce ..... 362/340

* cited by examiner

*Primary Examiner*—Sandra O'Shea
*Assistant Examiner*—Ismael Negron
(74) *Attorney, Agent, or Firm*—Perkins, Smith & Cohen, LLP; Harvey Kaye; Jerry Cohen

(57) ABSTRACT

A luminaire for creating a uniform light pattern on an architectural surface, in the form of uniformly diminishing light with the distance from the light source. The luminaire includes a quasi point light source arranged vertically in the vicinity of an architectural surface, and a multi-zone refractor assembly radially surounding the light source and bending the light from the source toward the architectural surface. There is a reflector above the light source for reflecting light from the source toward the architectural surface. The refractor assembly may include a Fresnel lens, a lower refracting condenser ring, a toroidal reflector, or a conical reflecting surface. The uppermost zone of the refractor assembly can include a reflector structure which collects and projects 180 degrees of the light from the light source in the same radial zone as the reflector structure toward and onto an upper conical reflector, and the reflector structure can include a parabolic reflector and a conical reflector. The lowermost zone of the refractor assembly may include a reflector structure which collects and projects 180 degrees of the light from the light source toward and onto a lower conical reflector. This zone may include a reflector structure which collects and projects 180 degrees of the light from the light source toward and onto a lower conical reflector. The refractor assembly can include a reflector structure which collects and projects 180 degrees of the light from the light source in the same radial zone as the reflector structure toward the upper reflector. There is a lower reflector which collects 180 degrees of the light from the light source and projects it toward and onto the architectural surface. The light source is selectively movable vertically to change the angular relationships of the refractor assembly and the light source. There is a collimating ring surrounding the portion of the light source which is on the opposite side thereof from the reflector structure. The reflector structure can include an ellipsoidal reflector and a conical reflector. There is a ring condenser surrounding the portion of the light source which is on the opposite side thereof from the reflector structure. The refractor assembly may include a wedge prism ring structure. There are a plurality of such luminaires spaced from each other and which provide overlapping light patterns on the architectural surface. The luminaire system can also include a plurality of remote refractors at least partially surrounding the refractor assembly for further modifying and distributing light being received from the refractor assembly. There can be a plurality of remote refractors radially surrounding the light source and which includes a lens prism or a ring lens segment or a prismatic surface. The luminaire can include at least one remote reflector at least partially surrounding the refractor assembly for further distributing light being received from the refractor assembly. The light source may be attached to a post intended to be set into the ground, and said refractor assembly including a radial lens and the radial lens can include a collimating ring section and a flange disk section.

8 Claims, 11 Drawing Sheets

Fig. 6

6" From Wall
A S
FP
10
Z1
Z2
Z3
Z4
Z5
Z6
Z7
Z8
10,000CP
20,000CP
30,000CP
40,000CP
50,000CP
60,000CP
70,000CP
80,000CP

DEVICES AND METHODS FOR DISTRIBUTING RADIALLY COLLECTED AND COLLIMATED LIGHT

CROSS REFERENCE TO RELATED APPLICATIONS

This application is based on and claims the priority of provisional patent application Ser. No. 60/130,904 filed Apr. 23, 1999.

FIELD OF THE INVENTION

The present invention relates generally to the lighting field, and, more particularly, to radial luminaires.

BRIEF SUMMARY OF THE INVENTION

One object of the present invention is to create evenly distributed illumination from a luminaire that is mounted on and close to the surface that is to be illuminated.

Another object of the present invention is to create illumination over a 360° area surrounding the luminaire.

A further object of the present invention is to efficiently project 180° of radial illumination (or any other segment of 360°).

A still further object of the present invention is to provide a method for directing segments of 360° distribution by manually rotating a portion, of the luminaire.

Yet another object of the present invention is to provide decorative light patterning through the adoption of "satellite" reflective or refractive elements that intercept and redirect the radial light distribution.

These objects and others are accomplished according to the present invention by providing a luminaire for creating a uniform light pattern on an architectural surface, in the form of uniformly diminishing light with the distance from the light source. The luminaire includes a quasi point light source arranged vertically in the vicinity of an architectural surface, and a multi-zone refractor assembly radially surounding the light source and bending the light from the source toward the architectural surface. There is a reflector above the light source for reflecting light from the source toward the architectural surface. The refractor assembly may include a Fresnel lens, a lower refracting condenser ring, a toroidal reflector, or a conical reflecting surface. The uppermost zone of the refractor assembly can include a reflector structure which collects and projects 180 degrees of the light from the light source in the same radial zone as the reflector structure toward and onto an upper conical reflector, and the reflector structure can include a parabolic reflector and a conical reflector. The lowermost zone of the refractor assembly may include a reflector structure which collects and projects 180 degrees of the light from the light source toward and onto a lower conical reflector. This zone may include a reflector structure which collects and projects 180 degrees of the light from the light source toward and onto a lower conical reflector. The refractor assembly can include a reflector structure which collects and projects 180 degrees of the light from the light source in the same radial zone as the reflector structure toward the upper reflector. There is a lower reflector which collects 180 degrees of the light from the light source and projects it toward and onto the architectural surface. The light source is selectively movable vertically to change the angular relationships of the refractor assembly and the light source. There is a collimating ring surrounding the portion of the light source which is on the opposite side thereof from the reflector structure. The reflector structure can include an ellipsoidal reflector and a conical reflector. There is a ring condenser surrounding the portion of the light source which is on the opposite side thereof from the reflector structure. The refractor assembly may include a wedge prism ring structure. There are a plurality of such luminaires spaced from each other and which provide overlapping light patterns on the architectural surface. The luminaire system can also include a plurality of remote refractors at least partially surrounding the refractor assembly for further modifying and distributing light being received from the refractor assembly. There can be a plurality of remote refractors radially surrounding the light source and which includes a lens prism or a ring lens segment or a prismatic surface. The luminaire can include at least one remote reflector at least partially surrounding the refractor assembly for further distributing light being received from the refractor assembly. The light source may be attached to a post intended to be set into the ground, and said refractor assembly including a radial lens and the radial lens can include a collimating ring section and a flange disk section.

BRIEF DESCRIPTION OF THE DRAWINGS

FIG. 1F is a diagrammatic view of the luminaire of FIG. 1.

DETAILED DESCRIPTION OF THE DRAWINGS

Figure 1:
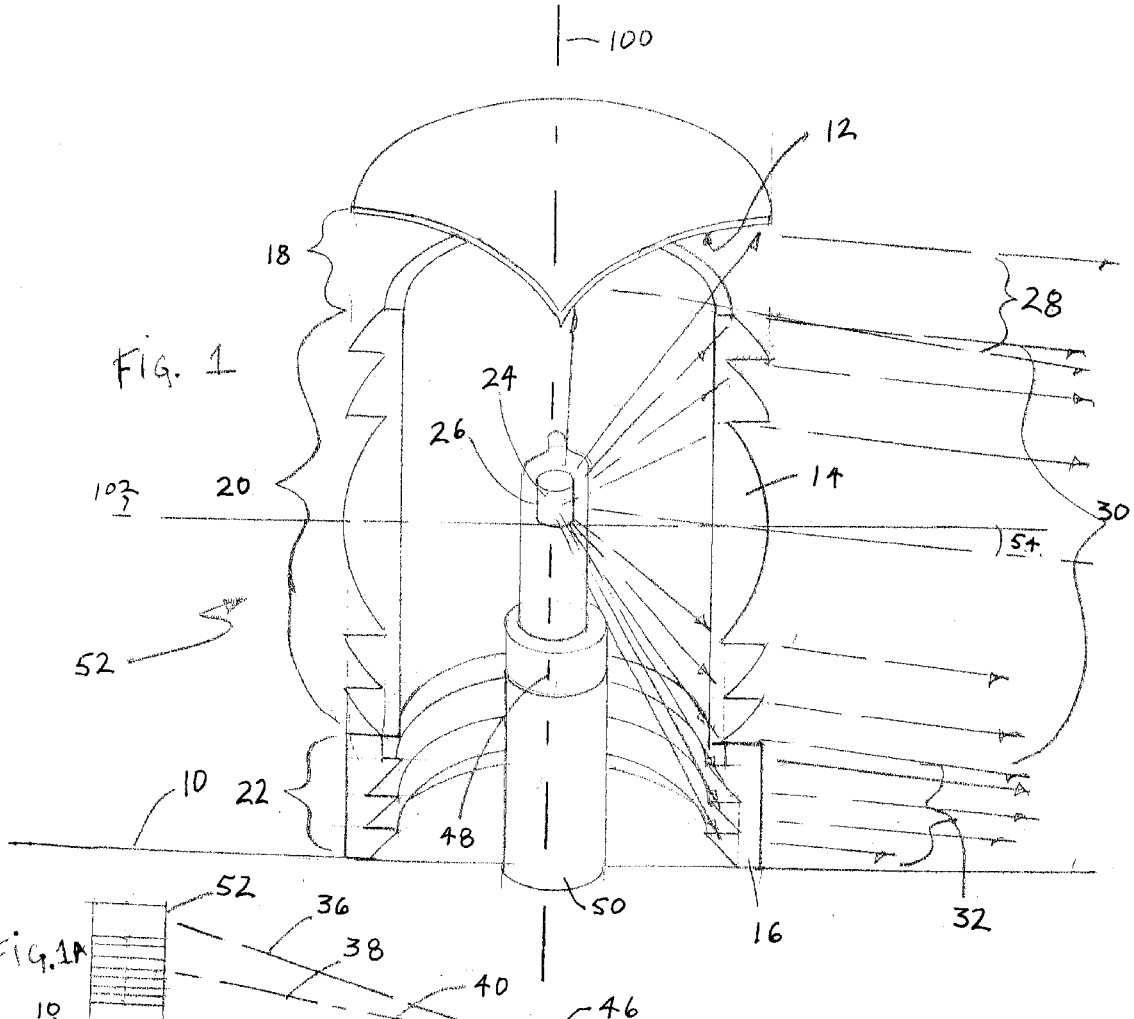
FIG. 1 is an isometric view of a luminaire of the present invention.

FIG. 1 is an isometric section of a luminaire or radial projection system 52 designed to project 360° of radial illumination towards and onto architectural surface 10. The luminaire is constructed of three optical elements: an upper parabolic (or ellipsoidal) reflector cone or optical elements or reflector 12, a Fresnel condensing ring lens or optical element 14, and a lower refracting condenser ring 16. Elements 12, 14 and 16 occupy the vertical zones of the luminaire or optical zone 18, 20 and 22, respectively.

A luminaire may be constructed using only a single optical element within a single zone for various architectural lighting applications. Each optical element 12, 14 and 16 is designed to capture a vertical segment of light radiation from arc tube or focal light point 24 within lamp or point source 26 which is in a lamp socket 48 in a lamp base 50, and radially collimate and project radial beams or ray groups or rays 28, 30 and 32 toward adjacent surface 10 so as to create a uniform pattern of radial illumination on surface 10. Since each optical element functions independently of each other, it is possible to aim ray groups 28 and 30 at the same circumferential architectural target to increase brightness on that target. This can be achieved by changing the beam focal distance of reflector 12 (if ellipsoidal) or the distance between arc tube 24 and reflector 12 (if parabolic) and by changing the distance between arc tube 24 and the optical center 102 of lens 14, respectively. Angle 54 which is the angle between the optical axis or optical axis 102 and rays 30 will become more acute as the distance between the optical axis 102 and arc tube 24 decreases.

Figure 1A:
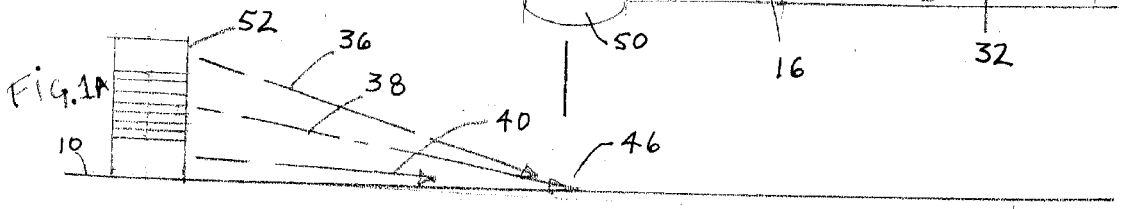
FIG. 1A is a diagrammatic view of the luminaire of FIG. 1.

FIG. 1A demonstrates the above principle by showing the centerlines of the ray groups 36, 38 and 40 generated by luminaire 52 and aimed at circumferential area 46.

Figure 1B:
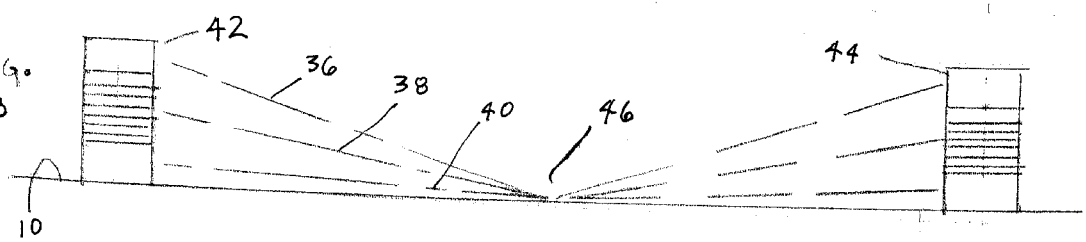
FIG. 1B is a diagrammatic view of two luminaire similar to FIG. 1.

FIG. 1B shows two luminaires 42 and 44, both projecting radial beams (the centerlines of which represent the highest level of candlepower for each beam) toward intersecting circumferences of illumination.

Figure 1C:
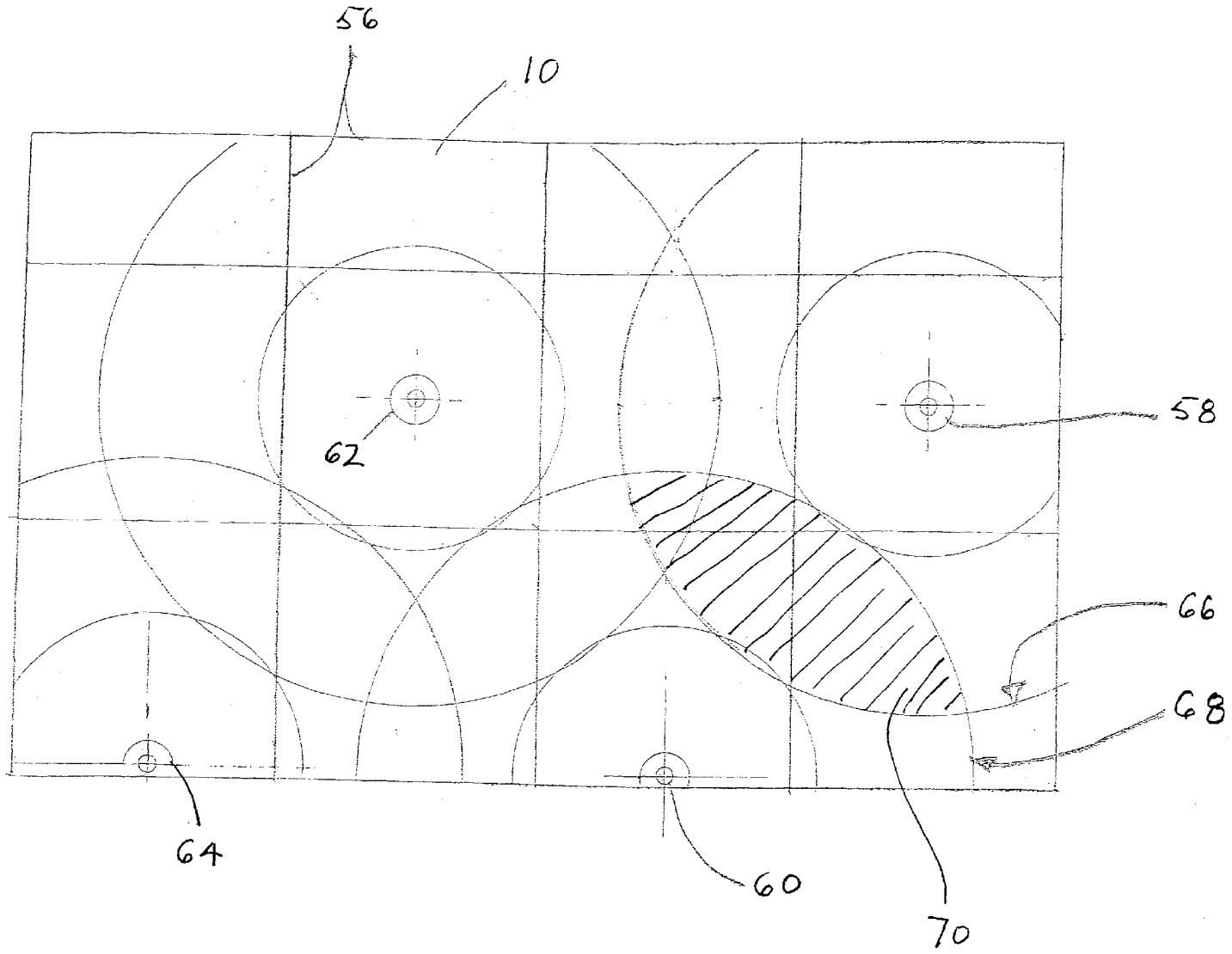
FIG. 1C is a plan view of an arrangement of luminaires.

FIG. 1C is a plan view of an architectural surface 10 segmented into grid 56 with luminaires 58, 60, 62 and 64. Circular bands 66 and 68 are shown to overlap. The overlapping of bands 66 and 68 increase visual brightness on surface 10 within zone 70 and decrease the shadowing caused by the grazing of illumination at an acute angle of projected light from a single luminaire.

Figures 1D, 1E:
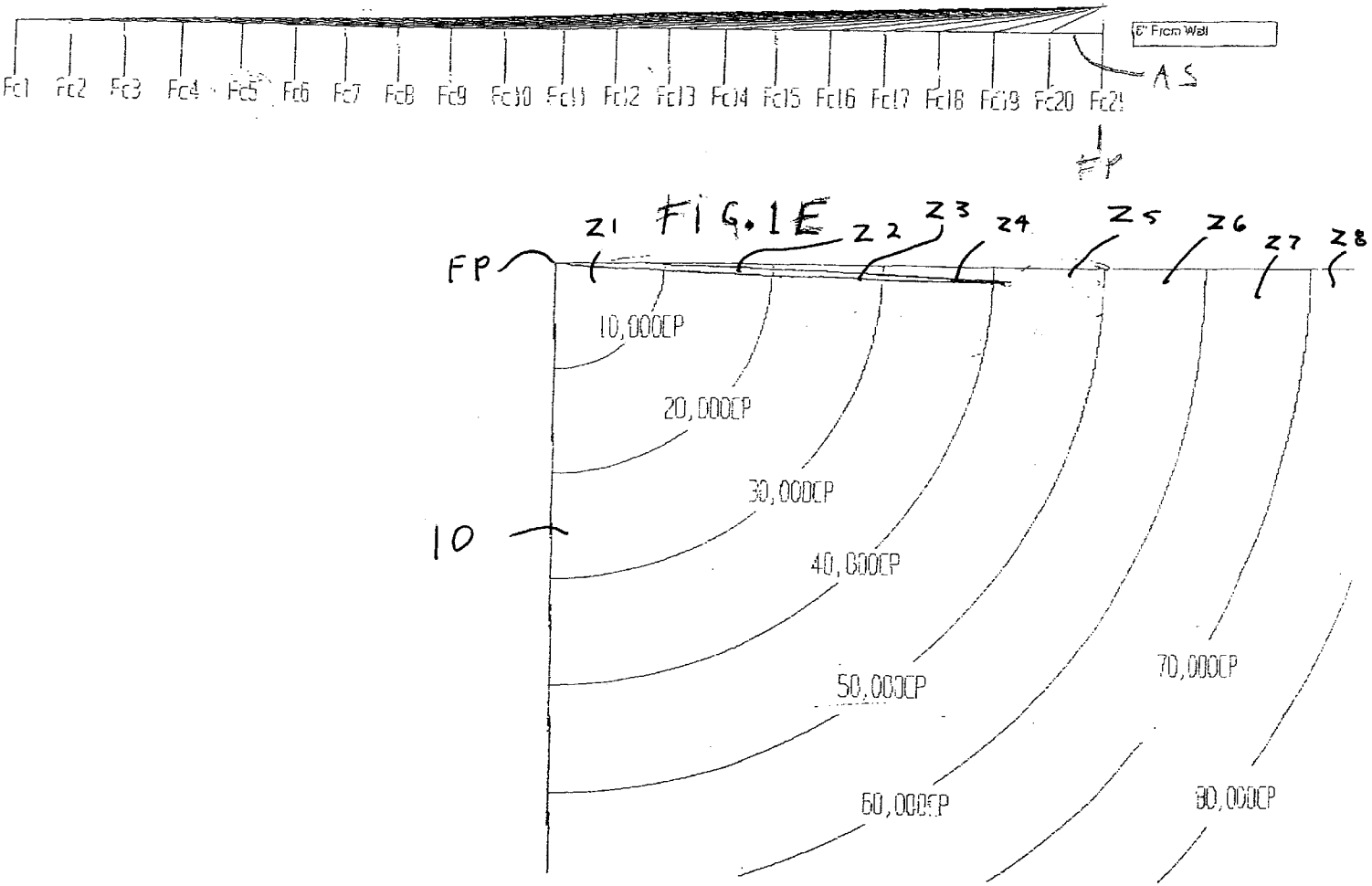
FIG. 1D is a diagrammatic view of the luminaire of FIG. 1.

FIG. 1D represents the angular projection (and section) of a radial beam projected toward and onto architectural surface 10, the centerline of the beam being point source 26 (as in FIG. 1), and, for descriptive purposes, is 6" above architectural surface 10, and is located perpendicular to architectural surface 10 at point FP. Numbers FC20 (located at the center of the luminaire and 20 feet from FC1) through FC1 represent a gradual tapering of foot candlepower on architectural surface 10. This chart is a sample only of preferred light distribution patterns.

FIG. 1E is a chart showing the central candlepower of the radial beam required to achieve the foot candle brightness shown in FIG. 1D. FP represents the light center projecting outward toward concentric zones on architectural surface 10. Each zone Z1–Z8 is noted with the candle power 10,000 through 80,000, respectively.

Figure 2:
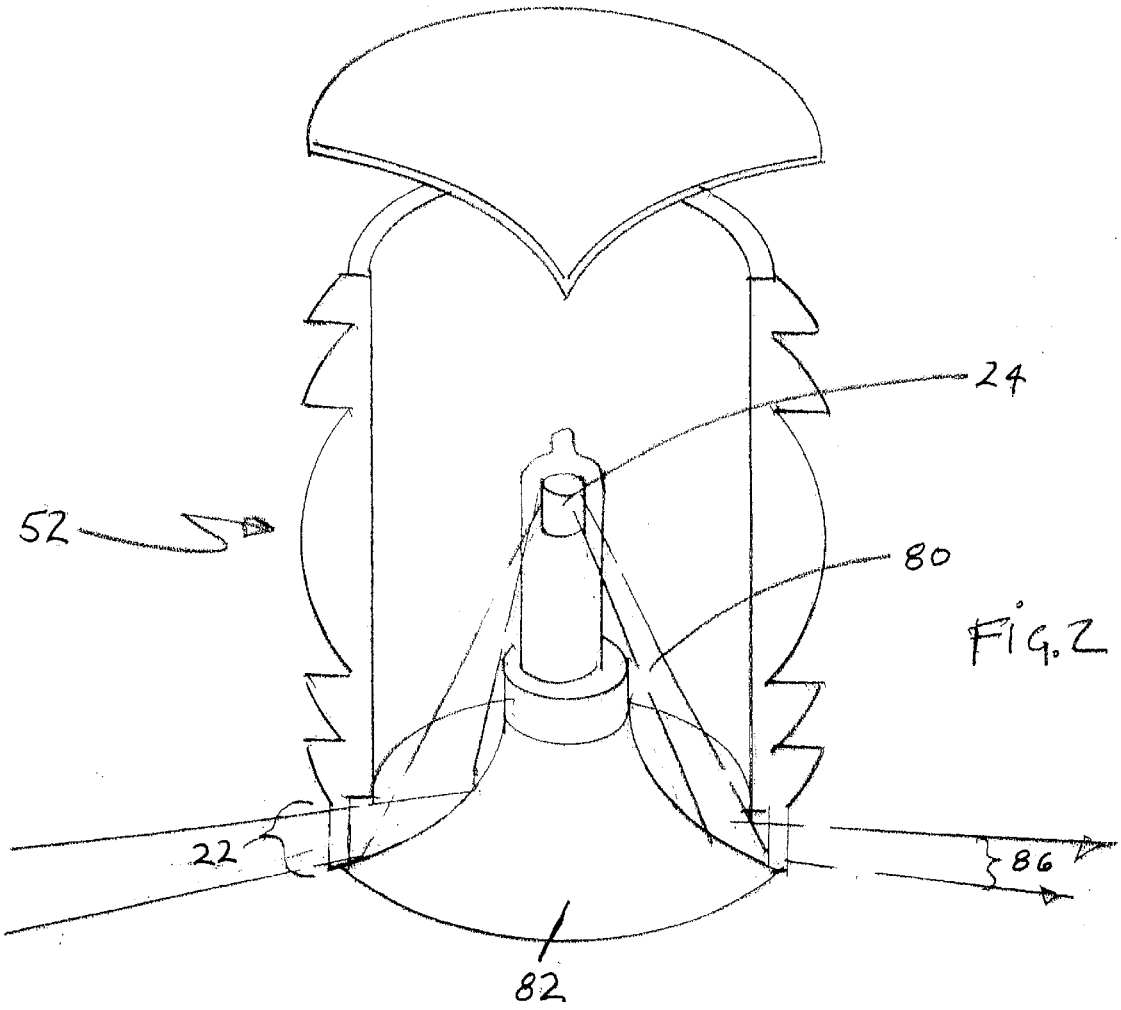
FIG. 2 is an isometric view of a radial projection system.

FIG. 2 is an isometric view of radial projection system 52, differing from the radial projection system 52 shown in FIG. 1 in that optical zone 22 is comprised of a torodial reflector 82 that may be sectionally negatively or positively parabolic, negatively or positively circular, or negatively or positively ellipsoidal. Reflector 82 collects and projects light rays 80 radiating from arc tube 24 as radial beam 86.

Figure 3:
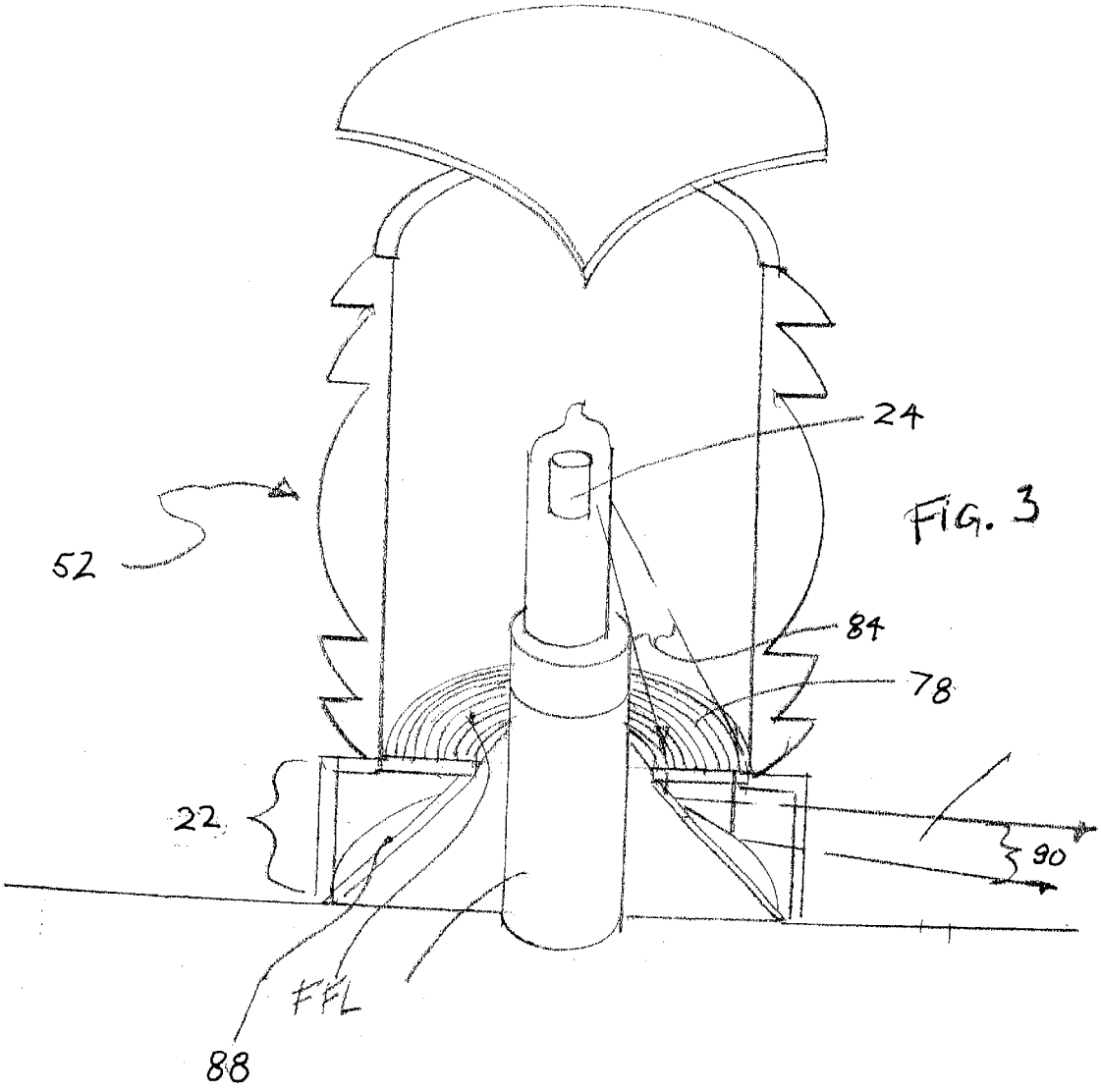
FIG. 3 is an isometric view of a modified radial projection system.

FIG. 3 is an isometric view of radial projection system 52, differing from the radial projection system shown in FIG. 1 in that optical zone 22 is comprised of focusing lens 78 (that may be plano convex, double convex, or of a Fresnel variety) which collects and focuses rays 84 (radiating from arc tube 24) which rays are reflected by substantially conical reflecting surface 88 as radial rays 90.

Figure 4:
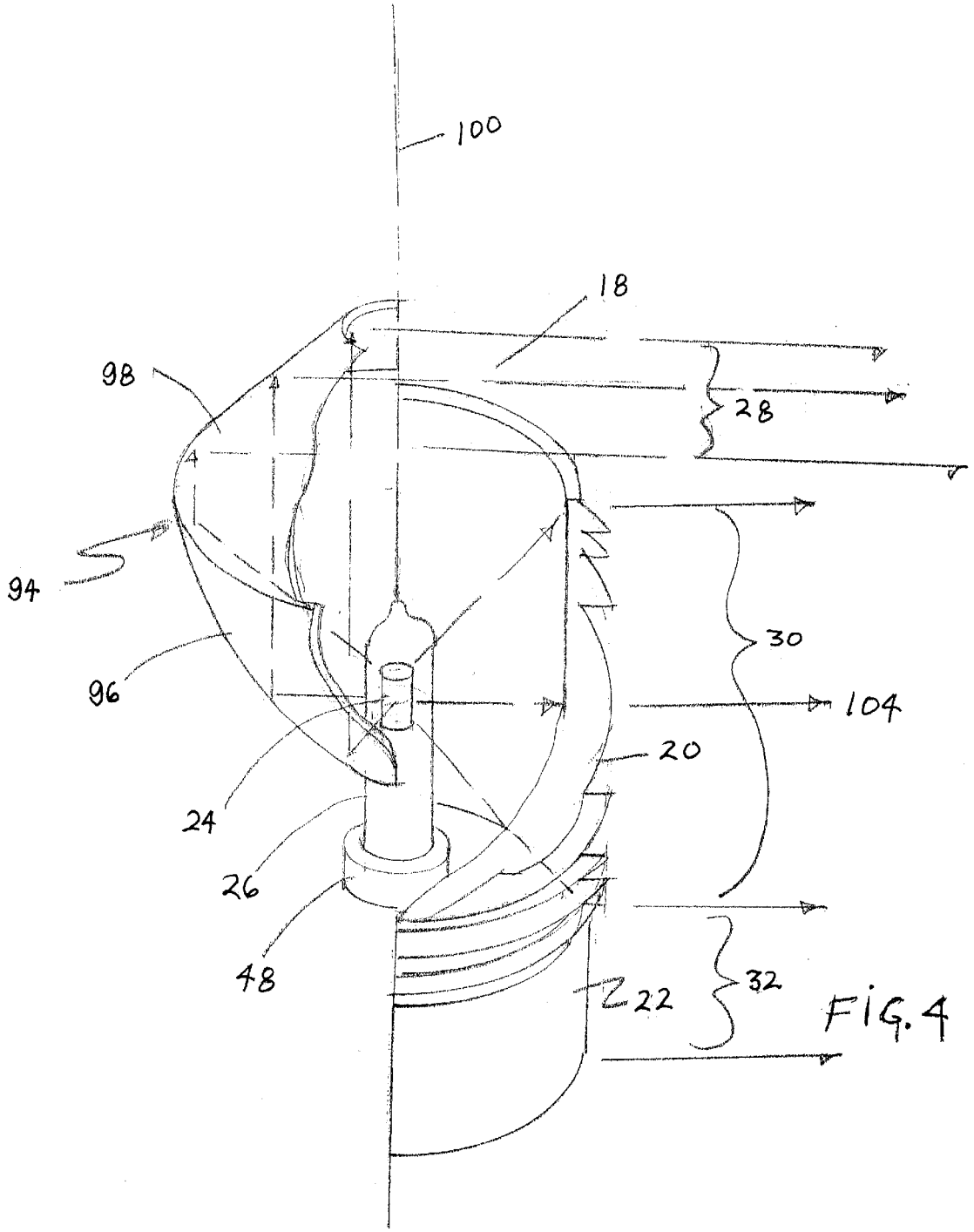
FIG. 4 is an isometric of a 180 degree radial beam projector.

FIG. 4 is an isometric view of a 180° radial beam projector. Optical zones 20 and 22 are comprised of 180° sections of optical components described in FIGS. 1, 2, or 3. Zone 18 is a result of reflecting structure 94 that is a composite of a 180° parabolic reflector 96 and a 180° conical reflector 98. Parabolic reflector 96 collects and projects 180° of the light flux radiating from arc tube 24 toward and onto conical reflector 98. Conical reflector 98 reflects and redirects the light from parabolic reflector 96 through light axis or vertical light center 100 as radial beam 28. Beams or ray groups 28, 30, and 32, may be radially parallel, or at acute diverging or converging angles to each other (as shown in FIGS. 1A and 1B). The center of beam 30 is beam axis line 104.

Figure 5:
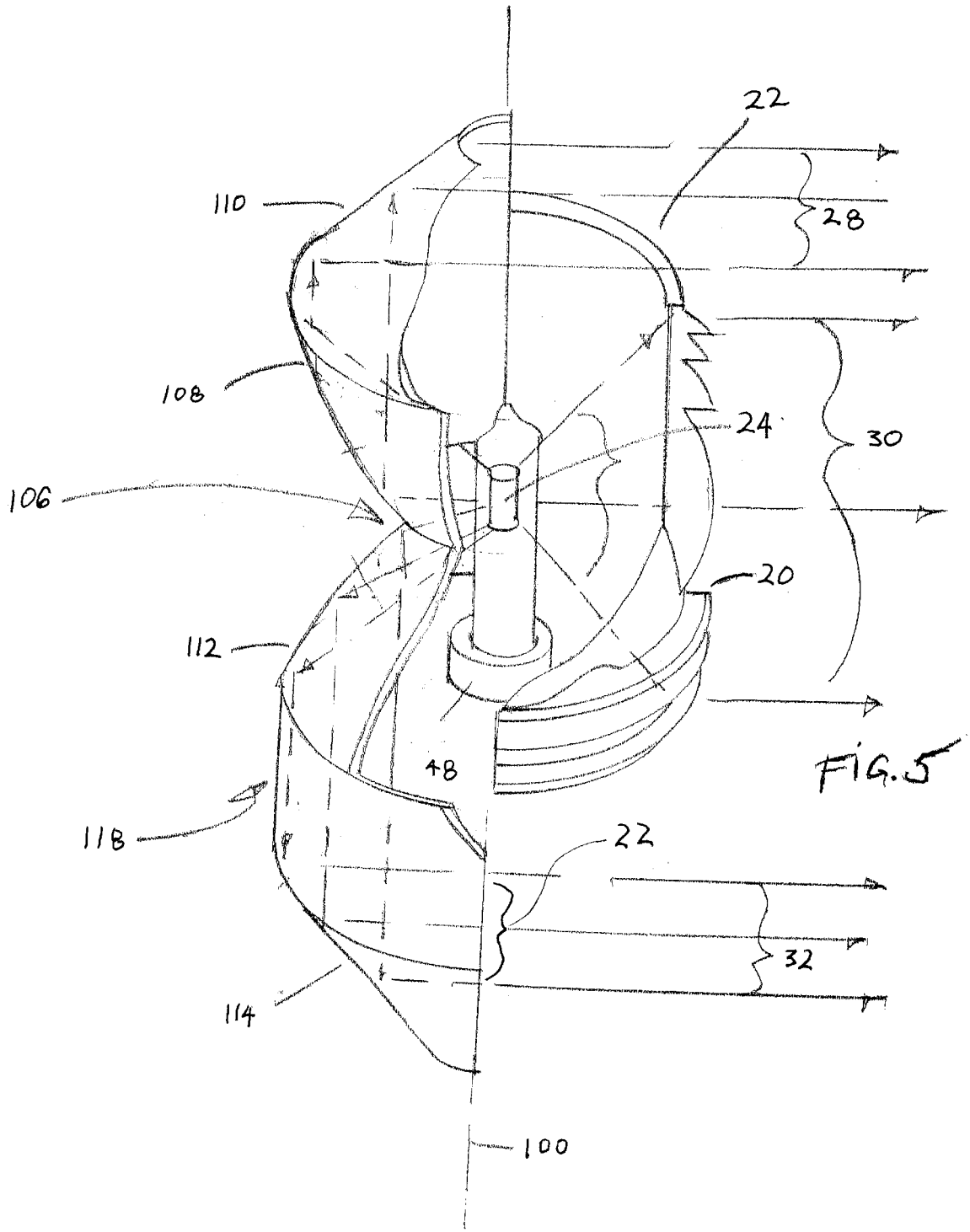
FIG. 5 is an isometric view of a 180 degree radial beam projector similar to that shown in FIG. 4.

FIG. 5 is an isometric view of a 180° radial beam projector differing from that illustrated in FIG. 4 in that reflector or reflecting structure 106 is comprised of two parabolic reflectors joined about and surrounding the focal light point 24. The upper portion of upper reflector structure 106 (comprising upper portion or reflector ring 108 and upper portion 110) functions as the parabolic reflector 96 and conical reflector 98 of FIG. 4. The lower portion of the reflecting structure 106 (comprised of a parabolic reflector 112 and a conical reflector 114) functions to project and focus light through light axis 100 below lamp socket 48, resulting in radial beam 32 within zone 22. A spacer or space 118 may be necessary between parabolic reflector 112 and conical reflector 114 to provide clearance below lamp socket 48 for rays 32.

Figure 6:
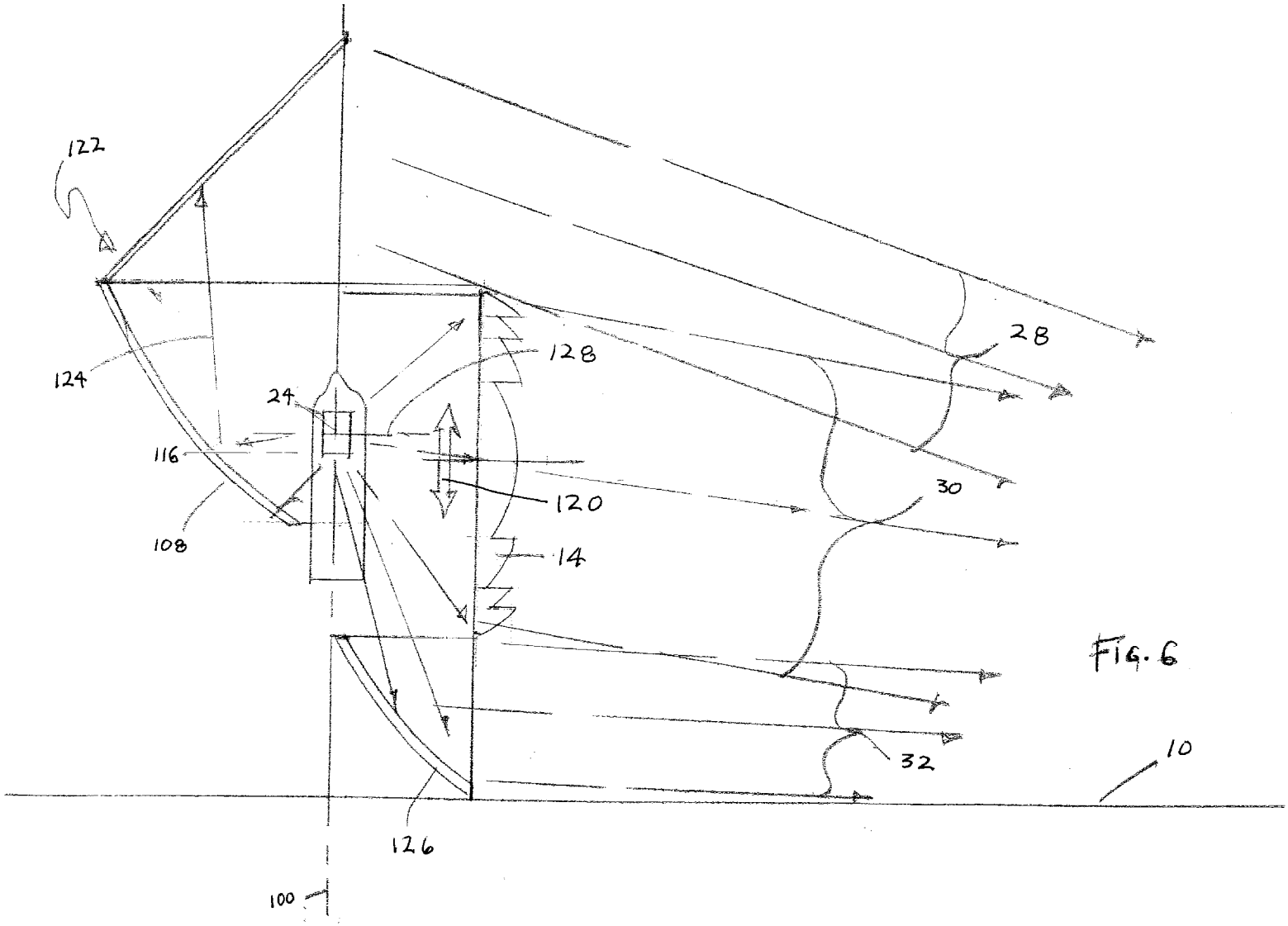
FIG. 6 is a side view, partly in section, showing the separate beam directing functions of a 180 degree radial beam projecting luminaire.

FIG. 6 is illustrates the separate beam directing functions of a 180° radial beam projecting luminaire that is a composite of discrete light collection and projection elements. By increasing the distance of light center 128 of 24 from the optical center 102 of lens 14 the acuteness of the convergence of beam 30 to surface 10 is decreased. Similarly arc tube 24 may be vertically shifted in relationship to the optical center 116 of reflector ring 108 changing the angle of projected beam 124 in relationship to vertical light center 100 changing the striking angle of beam 124 on conical reflector 122 and therefore changing the convergence angle of rays 28 to 10.

Similarly, by changing the distance between arc tube 24 and the optical center of reflector ring 126 the angle between rays 32 and 10 can be altered. Arrow 120 shows the movement of the light up and down.

Figure 7:
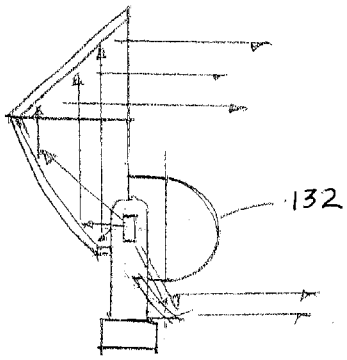
FIG. 7 is a diagram showing one form of the optical elements.
Figure 9:
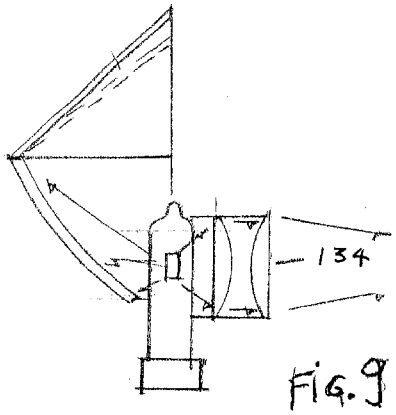
FIG. 9 is a diagram showing a further form of the optical elements.
Figure 8:
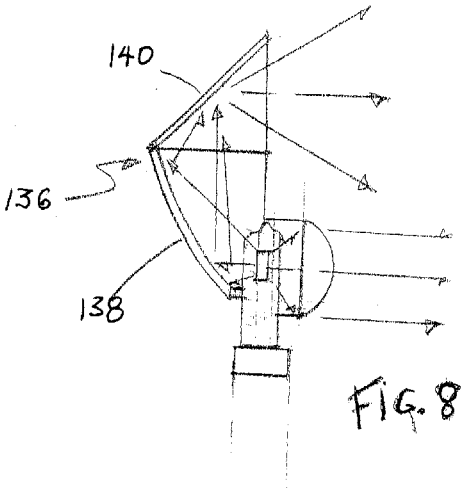
FIG. 8 is a diagram showing another form of the optical elements.
Figure 10:
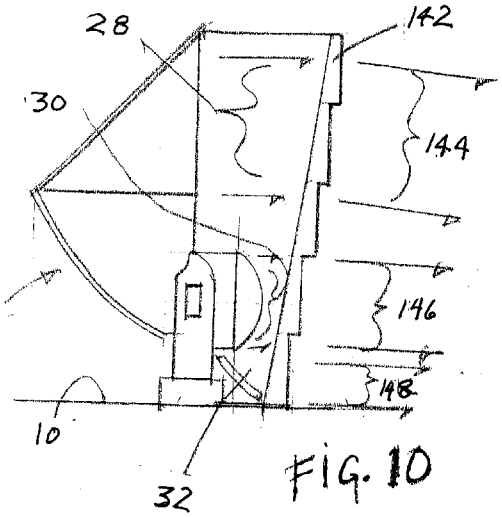
FIG. 10 is a diagram of a still further form of the optical elements.

FIGS. 7, 8, 9, and 10 are diagrams representing changes in the optical elements contained within the optical structure of FIG. 4. FIG. 7 contains a collimating ring 132 having an aspheric or spherical sections. FIG. 9 has ring condenser 134 comprised of two concentric ring lenses, both having a plano-convex and/or double convex profiles. FIG. 8 illustrates a 180° radial projector having a beam reversing structure 136 that is comprised of an ellipsoidal reflector 138 and a conical reflector 140. FIG. 10 illustrates a 180° radial beam projector where radial beams 28, 30 and 32 are being refracted towards architectural surface 10 by wedge prism ring structure 142, as 144, 146 and 148, respectively.

Figure 11:
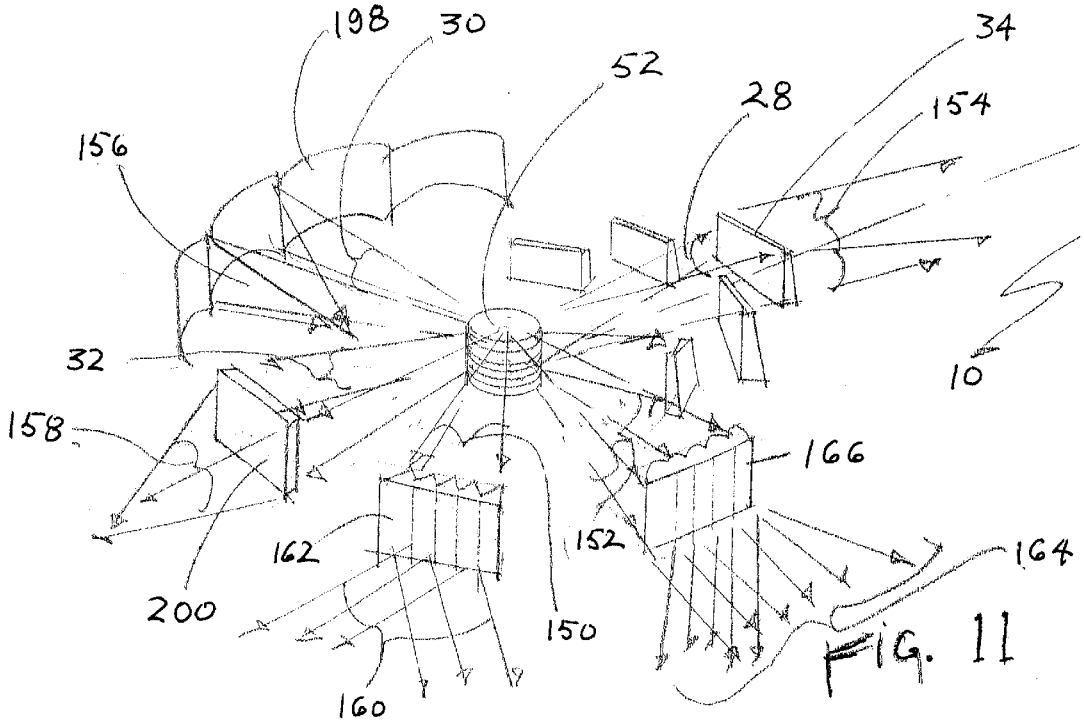
FIG. 11 is an isometric view of a radial beam projector mounted to an archtectural surface and showing a variety of refractor/reflector elements.

FIG. 11 is an isometric view of a radial beam projector 52 that is mounted to an architectural surface 10 and surrounded by a sampling of types of satellite reflecting and refracting devices that intercept radial light (radial beams 28, 30, 32, 150 and 152) and refract or reflect them towards architectural surface 10, or self-illuminate through internal light scattering.

Beam 28 (projected by radial beam projector 52) is refracted and directed towards architectural surface 10 as beam pattern 154 by wedge prism 34. Beam 30 (projected by radial beam projector 52) is reflected back towards architectural surface 10 by cylindrical (concave, convex, spherical, etc.) reflector 198 as beam pattern 156. Beam 32 is focused by refractor 200 towards architectural surface 10 as beam pattern 158. Radial beam 150 is refracted into rays 160 and directed towards architectural surface 10 by lens prism 162. Radial beam 152 is refracted into a converging then diverging pattern of overlapping beams 164 by cylindrical lens prism 166, which also directs overlapping beams 164 toward architectural surface 10.

All refracting and reflecting elements may have color added to change the color patterns of refracted or reflected beams.

Figure 12:
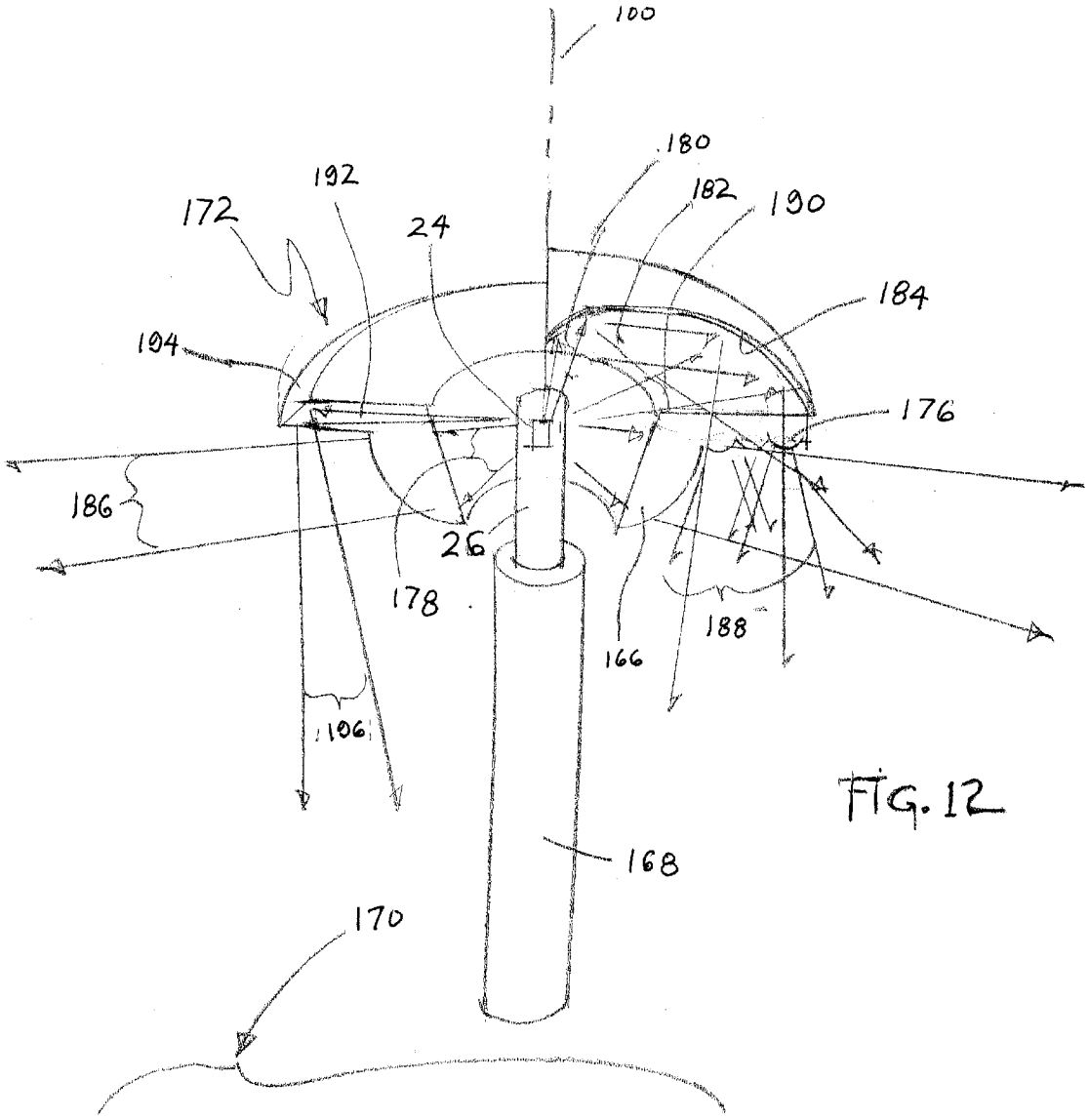
FIG. 12 is an isometric view, partly in section, of a close-to-surface radial luminaire.

FIG. 12 is a sectional isometric view on a close-to-surface radial luminaire that may be used as a pathway light. Lamp 26 is attached to post 168 mounted on ground surface 170. Radial lens 172 configuration is comprised of a collimating ring section 174 and a flange disk section 176. Radial lens 172 surrounding lamp 26 is designed to radially collimate a portion of the radiant light 178 from lamp 26. A radial reflector configuration sits above and shares the same vertical light axis as RRS. An upper portion 180 of the radiant light from arc tube 24 is reflected as rays 182 and further reflected by reflector 184 through 176 as ray 188.

Central radiant rays 190 are also reflected by reflector 184 through 176 as rays 188. Flange disk section 176 may have refractive V grooves, radially disposed concave or convex rings, or any other prismatic scattering surface.

Optionally, flange disk section176 may be used as a radial light guide for radiant rays 192 that pass through flange disk section 176 and are reflected by prismatic surface 194 as rays 196.

As described in connection with FIG. 6, light center 24 may be moved up or down along 100, changing its position in relationship to radial lens172 and reflector 184, and therefore changing projection angles of radial beam RB and downward beam 188 respectively.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A luminaire for creating a uniform light pattern on an adjacent architectural surface, comprising:

a. a quasi point light source arranged vertically in the vicinity of an architectural surface;

b. a multi-zone optical assembly radially surrounding said light source for its vertical length, and including a Fresnel lens and a composite reflector of a parabolic ring section and a conical reflector lens which surround the source for at least 180° radially, for bending the light from said source toward the architectural surface for evenly illuminating a broad area of the architectural surface.

2. A luminaire as defined in claim 1 where the optical element is a refractor assembly which includes a reflector structure which collects and redirects 180 degrees of the light from the light source in the same radial zone as the reflector structure toward and onto an upper conical reflector.

3. A luminaire as defined in claim 1 wherein said reflector structure includes a parabolic reflector and a conical reflector.

4. A luminaire as defined in claim 1 wherein the lowermost zone of the refractor assembly includes a reflector structure which collects and projects 180 degrees of the light from the light source toward and onto a lower conical reflector.

5. A luminaire as defined in claim 1, wherein the lowermost zone of the refractor assembly includes a reflector structure which collects and projects 180 degrees of the light from the light source toward and onto a lower conical reflector.

6. A luminaire as defined in claim 1, wherein the refractor assembly includes a reflector structure which collects and projects 180 degrees of the light from the light source in the same radial zone as the reflector structure toward the upper reflector.

7. A luminaire as defined in claim 6 wherein there is a lower reflector which collects 180 degrees of the light from the light source and projects it toward and onto the architectural surface.

8. A luminaire as defined in claim 1 wherein the light source is selectively movable vertically to change the angular relationships of the refractor assembly and the light source.

* * * * *